US010305207B2

(12) United States Patent
Li et al.

(10) Patent No.: US 10,305,207 B2
(45) Date of Patent: May 28, 2019

(54) CONNECTOR DESIGN FOR HIGH DENSITY PLATFORMS

(71) Applicant: INTEL CORPORATION, Santa Clara, CA (US)

(72) Inventors: Xiang Li, Portland, OR (US); George Vergis, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/622,001

(22) Filed: Jun. 13, 2017

(65) Prior Publication Data

US 2018/0358727 A1 Dec. 13, 2018

(51) Int. Cl.

| | |
|---|---|
| ***H01R 12/73*** | (2011.01) |
| ***H01R 12/72*** | (2011.01) |
| ***H01R 43/20*** | (2006.01) |
| *H01R 12/50* | (2011.01) |
| *H01R 13/64* | (2006.01) |

(52) U.S. Cl.

CPC ..... *H01R 12/721* (2013.01); *H01R 12/727* (2013.01); *H01R 12/737* (2013.01); *H01R 43/205* (2013.01); *H01R 12/73* (2013.01); *H01R 13/64* (2013.01); *H01R 23/7005* (2013.01); *Y10S 439/94* (2013.01)

(58) Field of Classification Search

CPC ..... H01R 12/73; H01R 12/737; H01R 13/64; H01R 23/7005; Y10S 439/94

USPC ..... 439/637, 633, 940

See application file for complete search history.

(56) References Cited

U.S. PATENT DOCUMENTS

| | | | | |
|---|---|---|---|---|
| 6,152,777 | A * | 11/2000 | Smith | H01R 13/6456 200/506 |
| 6,599,140 | B1 * | 7/2003 | Chen | H01R 43/0263 439/135 |
| 6,700,782 | B1 | 3/2004 | Bopp et al. | |
| 7,202,693 | B1 | 4/2007 | Kush | |
| 7,429,182 | B1 | 9/2008 | Zheng et al. | |
| 7,455,526 | B1 | 11/2008 | Ila et al. | |
| 7,524,199 | B2 | 4/2009 | Zheng et al. | |
| 9,385,444 | B2 | 7/2016 | Krithivasan et al. | |
| 2016/0181712 | A1 * | 6/2016 | Wig | H01R 12/7005 439/78 |

* cited by examiner

*Primary Examiner* — Abdullah A Riyami
*Assistant Examiner* — Justin M Kratt
(74) *Attorney, Agent, or Firm* — Konrad Raynes Davda & Victor LLP; Alan S. Raynes

(57) ABSTRACT

A surface mount connector includes a housing including inner surfaces surrounding a card edge region, and outer surfaces defining an exterior region. The connector also includes a recess in at least one of the outer surfaces, the recess sized to accept a removably engageable arm therein. The connector also defines a cross-sectional width that is smaller in the recess than at a position adjacent to the recess. Other embodiments are described and claimed.

20 Claims, 5 Drawing Sheets

CONNECTOR DESIGN FOR HIGH DENSITY PLATFORMS

TECHNICAL FIELD

Embodiments related generally to input/output interfaces used in electronic devices, including connectors such as surface mount connectors used for high density computer platforms.

BACKGROUND

Computer systems often include a board such as a motherboard including input/output interfaces such as connectors (also known as sockets) for coupling devices such as memory cards to the board. As computer needs such as memory increase, more connectors and memory cards may be mounted on the board.

BRIEF DESCRIPTION OF THE DRAWINGS

Embodiments are described by way of example, with reference to the accompanying drawings, in which like reference numerals may refer to similar elements.

DESCRIPTION OF EMBODIMENTS

References in the specification to "embodiments," "certain embodiments," "an embodiment," etc., indicate that the embodiment described may include a particular feature, structure, or characteristic, but every embodiment may not necessarily include the particular feature, structure, or characteristic. Moreover, such phrases are not necessarily referring to the same embodiment. Certain embodiments relate to connectors used to couple a card to a substrate such as a PCB (printed circuit board), for example, a motherboard. Embodiments include devices and methods.

When multiple connectors such as, for example, surface mount connectors, are coupled to a PCB, an efficient use of the real estate on the board may be important. In certain configurations, the real estate on the board is limited and adjacent connectors are positioned close to one another. A pick and place machine may be used grasp a connector and deliver it on the board, where a soldering process may be used to couple the connector to the board. The pick and place machine may include a grip mechanism including removably engageable arms that can be extended and retracted as desired to engage and grasp a connector and to release the connector when it is properly position on the board. If adjacent connectors are positioned too close to each other, when the grip is opened and the arms extended outward to release from the connector, an adjacent connector may be contacted by an arm of the grip. Such unwanted contact may move or dislodge the adjacent connector and create a failure or potential failure during subsequent procedures such as, for example, solder reflow.

Certain embodiments relate to providing connectors that can be positioned relatively close together, while providing adequate spacing so that an adjacent connector is not contacted by the arms of a pick and place grip when the grip is opened. Embodiments may include devices and methods.

Figure 1:
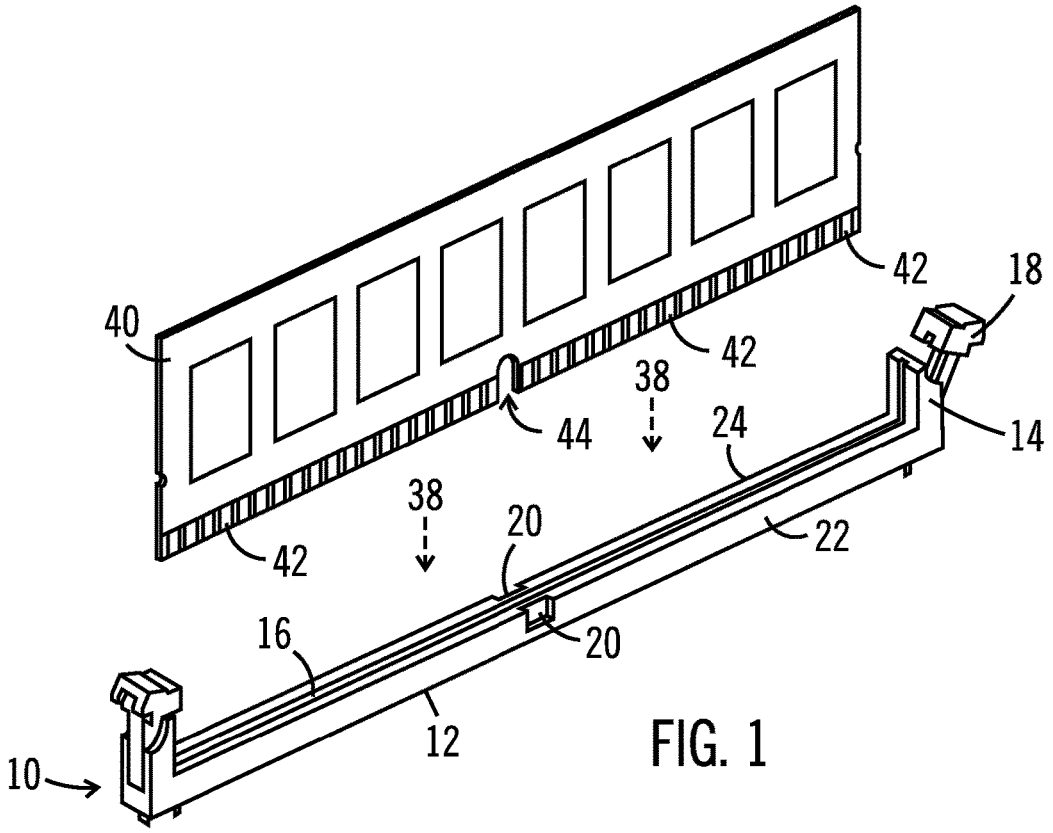
FIG. 1 illustrates a view of a connector, in accordance with certain embodiments.

FIG. 1 illustrates a view of a surface mount connector 10 used to couple a Dual In Line Module (DIMM) with JEDEC DDRx memory to a board. There are many connector types, including JEDEC DDRx connectors in accordance with standards including, for example, the DDR4 260 Pin SODIMM Connector Performance Standard, and the DDR4 288 Pin U/R/LR DIMM (unregistered/registered/load reduced DIMM) Connector Performance Standard. Volatile memory may be a storage medium that requires power to maintain the state of data stored by the medium. Non-limiting examples of volatile memory may include various types of random access memory (RAM), such as dynamic random access memory (DRAM) or static random access memory (SRAM). One particular type of DRAM that may be used in a memory module is synchronous dynamic random access memory (SDRAM). In particular embodiments, DRAM of a memory component may comply with a standard promulgated by Joint Electron Device Engineering Council (JEDEC), such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

The connector 10 include an elongated housing 12 including tower regions 14 at the end regions. The housing 12 may be configured to surround a slot 16 that defines a card edge region into which a card 40 such as a DIMM may be positioned. FIG. 1 shows dotted line arrows 38 indicating the direction of insertion for the card 40 into the slot 16, with the card edge adjacent to the pins 42 being inserted into the slot 16. The housing 12 may be formed from any suitable material including, but not limited to, a polymer such as a polyamide. The connector 10 includes contacts 28 (see FIG. 2A) in the interior slot 16 for engaging pins 42 on the card. The tower regions 14 each include an ejector 18 configured to latch onto and eject the card 40.

The housing 12 includes recesses 20 on the elongated sides 22, 24. The recesses 20 are sized to accept the arms of a pick and place machine for positioning the connector 10 onto a surface such as a printed circuit board. The connector 10 defines a cross-sectional width that is smaller in the recesses 20 portion of the connector 10 than at a position of the connector 10 adjacent to the recesses 20. By engaging the connector 10 in the recesses 20, the arms of the pick and place machine will extend outwards a smaller distance than if there were no recesses, which enables connectors to be positioned close together on a substrate surface.

Figure 2A:
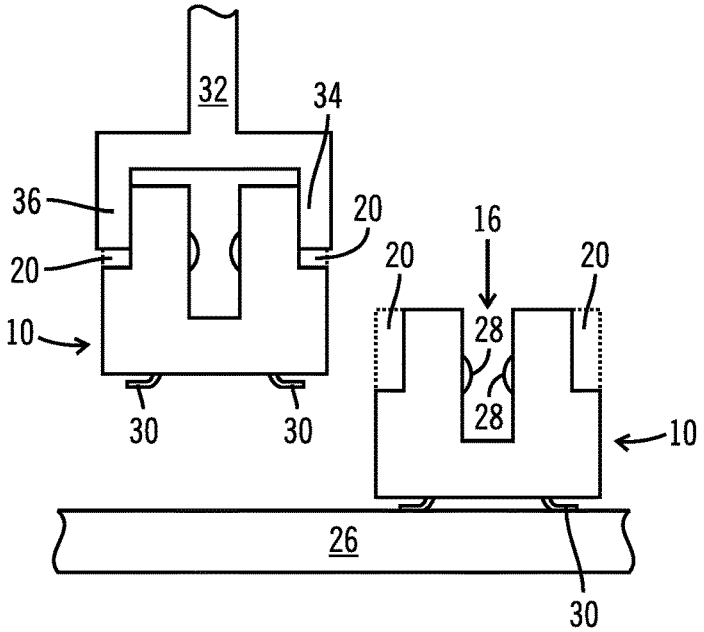
FIG. 2A-2C illustrate a connector being delivered to a board using a pick and place machine, in accordance with certain embodiments.
Figure 2B:
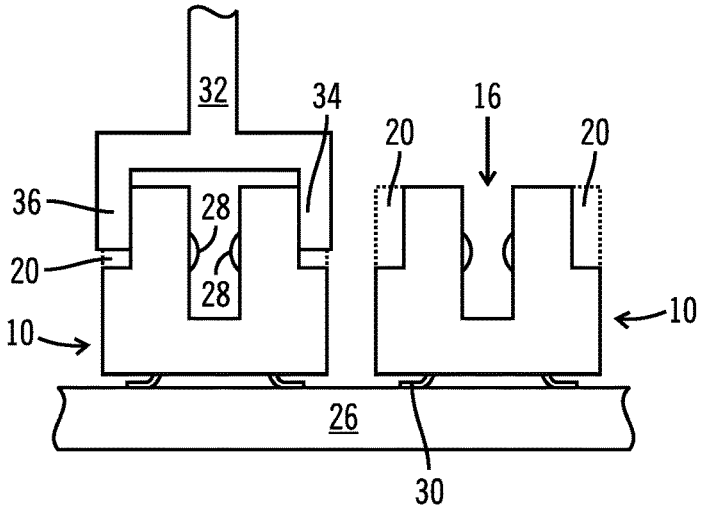
Figure 2C:
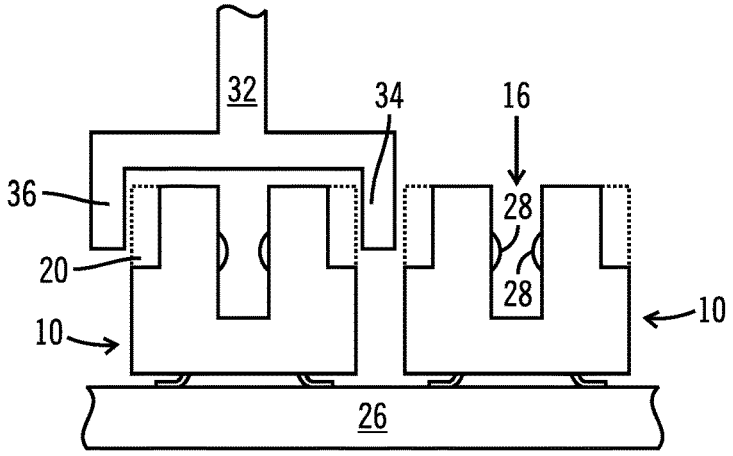

FIGS. 2A-2C illustrate an example of two connectors 10 being positioned adjacent to one another on a substrate 26, which may be, for example, a motherboard. The side view of the connectors 10 illustrates a cross section of certain features including the recesses 20 partially defined by dotted lines. The connectors 10 each include a plurality of contacts 28 configured to engage the pins on a card that will be inserted into the slot 16. The contacts 28 extend to terminals 30 for transmitting signals to and from the card. The terminals 30 may include solder for coupling to the substrate 26. As illustrated in FIG. 2A, the connector 10 on the left side of the figure is positioned in a pick and place machine 32 including arms 34, 36 grasping the connector 10, with the arms 34, 36 each engaging the housing 12 in a recess 20. The grasped connector 10 will be brought into position on the substrate 26 adjacent to the connector 10 on the right side of the figure.

FIG. 2B illustrates the grasped connector 10 positioned on the substrate 26. The substrate 26 may include pads on which the terminals 30 of the arms 34, 36 are positioned. A solder connection may be used to couple the connector 10 to the substrate 26.

FIG. 2C illustrates the opening of the grip of the pick and place machine 32, with the arms 34, 36 extending outward to decouple from the housing 12 of the connector 10 in the recesses 20. To ensure proper operation of the pick and place machine, the arms 34, 36 are extended a distance away from the side surfaces of the housing 12 to provide adequate clearance so that the pick and place machine can be moved away from the connector and the substrate. By providing the recesses 20 into which the arms 34, 36 were positioned, a sufficient distance is provided so that when the arms 34, 36 are extended outward, the adjacent connector 10 on the right side of the figure is not contacted by the arm 34. The presence of the recesses 20 permits the connectors 10 to be positioned closer together than if the recesses were not present. While two connectors 10 are illustrated in FIGS. 2A-2C, any desired number of connectors may be utilized.

The size of the recesses 20 are selected so that the arms 34, 36 of the pick and place machine 32 can fit within the recesses and so that the structural integrity of the connector is not compromised. The recesses 20 may in certain embodiments be rectangular in shape. Depending on the shape of the arms 34, 36 of the pick and play machine 32, other shapes are also possible. In certain embodiments, the recesses may have a length of about 4 mm to about 5 mm, a height of about 3 mm to about 4 mm, and a depth of about 1 to about 2 mm. The recesses may extend the height of the housing or may extend along a portion of the height of the housing. In certain embodiments the length of the connector is about 140 mm. In certain embodiments the height of the elongated sides of the connector (between the tower regions 14 in the embodiment illustrated in FIG. 1), may be about 6 mm. The recesses illustrated in FIG. 1 extend along a portion of the height of the housing 12, from the upper surface of the elongated sides 20, 22 downward.

As illustrated in FIG. 1, in certain embodiments the recesses 20 are positioned near the center of the elongated sides 22, 24 of the housing 12. In addition, in certain embodiments, the position of the recesses 20 is located so that when the card 40 is inserted, the recesses 20 are aligned with a key region 44 in the card 40. Such a configuration minimizes stresses on the housing 12 of the connector 10 because there will be no pins 42 engaging the connector 10 in the region between the recesses 20.

Certain embodiments permit the spacing of connectors to be considerably closer together than if the recesses are not present. For example, in the embodiment illustrated in FIGS. 3A-3C, the connectors 10 are positioned closer together than the width of the arm 34 of the pick and place machine 32. Such spacing would not be possible without the presence of a recess 20. Similar to FIGS. 2A-2C, FIG. 3A illustrates a connector 10 (on the left side of the figure) being brought towards a substrate 26 on which another connector 10 is positioned, FIG. 3B illustrates the left side connector 10 being positioned on the substrate 26, and FIG. 3C illustrates the pick and place machine arms 34, 36 being uncoupled from the left side connector 10.

Figure 3A:
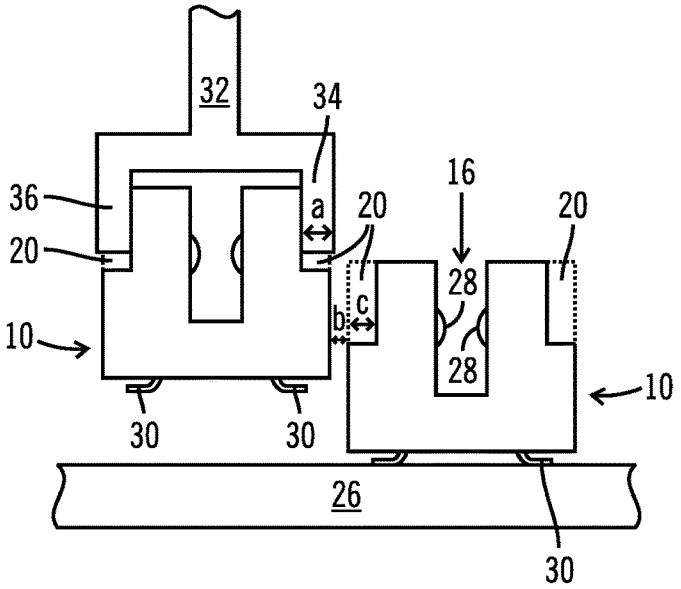
FIG. 3A-3C illustrate a connector being delivered towards a board using a pick and place machine, in accordance with certain embodiments.
Figure 3B:
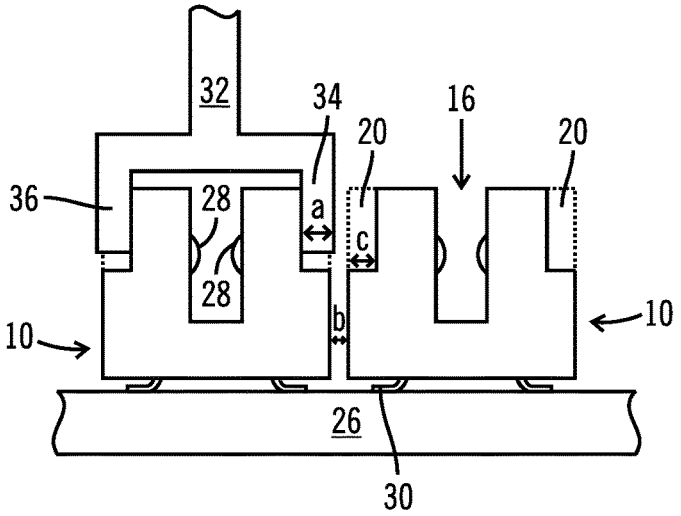
Figure 3C:
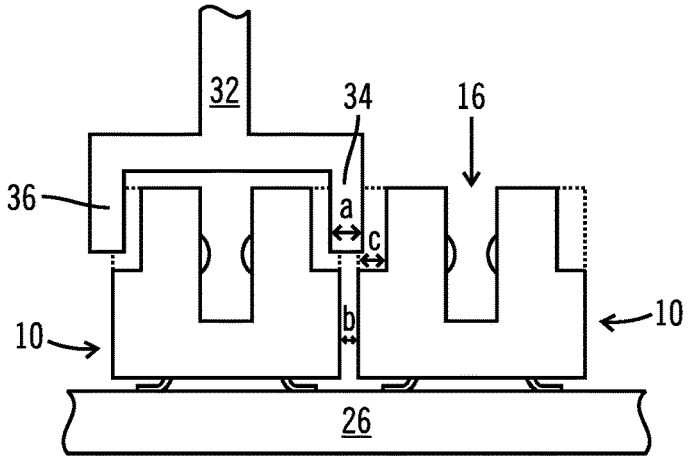

As illustrated in FIGS. 3A-3C, the pick and place machine 32 includes arm 34 having a dimension designated by "a". In addition, the connectors 10 are spaced apart a distance designated by "b". In addition, the recesses 20 may each have a dimension (depth) designated by "c". The dimension "a" is greater than the distance "b". The dimension "c" is also greater than the distance "b". If the recesses 20 facing each other in FIGS. 3A-3C were not present, such spacing would not be possible because the arm 34 (being wider than the distance between the connectors) would not fit between the connectors. Thus, the presence of the recesses 20 enables the connectors 10 to be positioned closer to one another than if the recesses 20 were not present. This saves valuable real estate on the substrate 26 surface. It should also be noted that while the arms 34, 36 are illustrated as having a dimension "a" that is greater than the dimension "c" of the recess, it may be possible that the arms 34, 36 can have a dimension that is less than the depth of the recess. In addition, any type of suitable arm mechanism may be utilized, for example, an arm may include a plurality of regions (for example, fingers) that engage and grip the connector in a recess.

Figure 4:
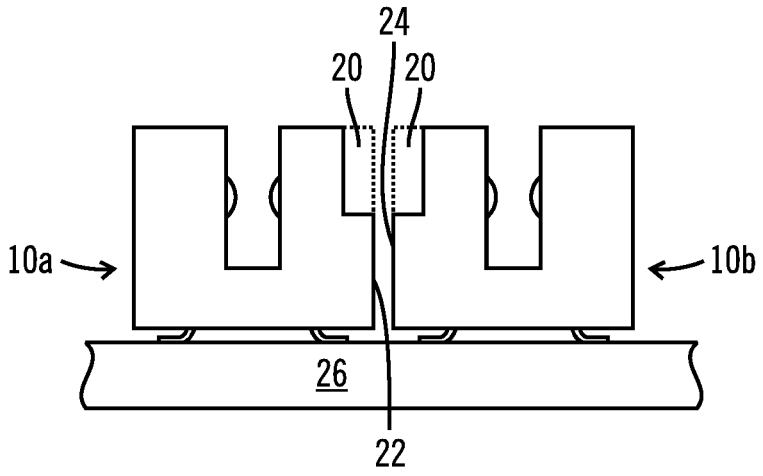
FIG. 4 illustrates of two connectors, in accordance with certain embodiments.

While FIGS. 1, 2A-2C, and 3A-3C illustrate the use of connectors having recesses on both elongated sides 22, 24 of the connector 10, embodiments may also include other recess configurations. FIG. 4 illustrates an embodiment including two connectors 10*a* and 10*b* on a substrate 26. The connectors 10*a* on the left side of the figure and 10*b* on the right side of the figure each include a single recess 20. The recesses 20 on the connectors 10*a* and 10*b* face towards each other to create a wider spacing therebetween. This enables the connectors 10*a* and 10*b* to be positioned close together while permitting adequate space for a pick and place machine arm to disengage from the connector after it is placed onto the substrate 26. In certain embodiments, such an embodiment with the recess on one side only may be used when the connector is at the end of a row of connectors, and the tight spacing for the pick and place arm is only needed on one side of the connector.

Figure 5:
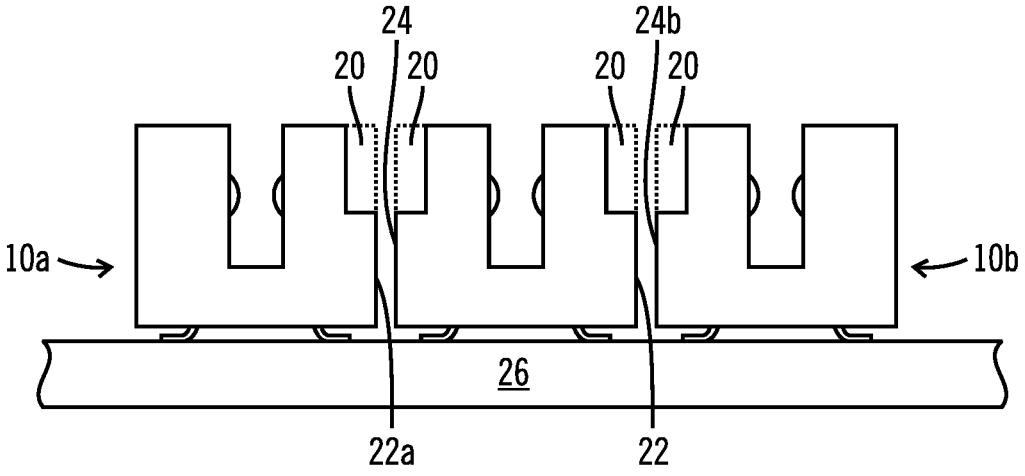
FIG. 5 illustrates three connectors, in accordance with certain embodiments.

FIG. 5 illustrates an embodiment including three connectors 10, 10*a*, and 10*b*, positioned on substrate 26. In this embodiment, the central connector 10 is positioned between connectors 10*a* and 10*b*. Central connector 10*a* includes recesses 20 on both sides 22, 24. Left side connector 10*a* includes a recess 20 on the right side 22*a*. Right side connector 10*b* includes a recess 20 on the left side 24*b*. While three connectors are illustrated in FIG. 5, more connectors having recesses on both sides could be present in the central region between the connectors 10*a* and 10*b*. Depending on the spacing needs in relation to other components that may be positioned on the substrate, the use of connectors with recesses on one side or both sides may be used for the connectors at the ends of the row.

Figure 6:
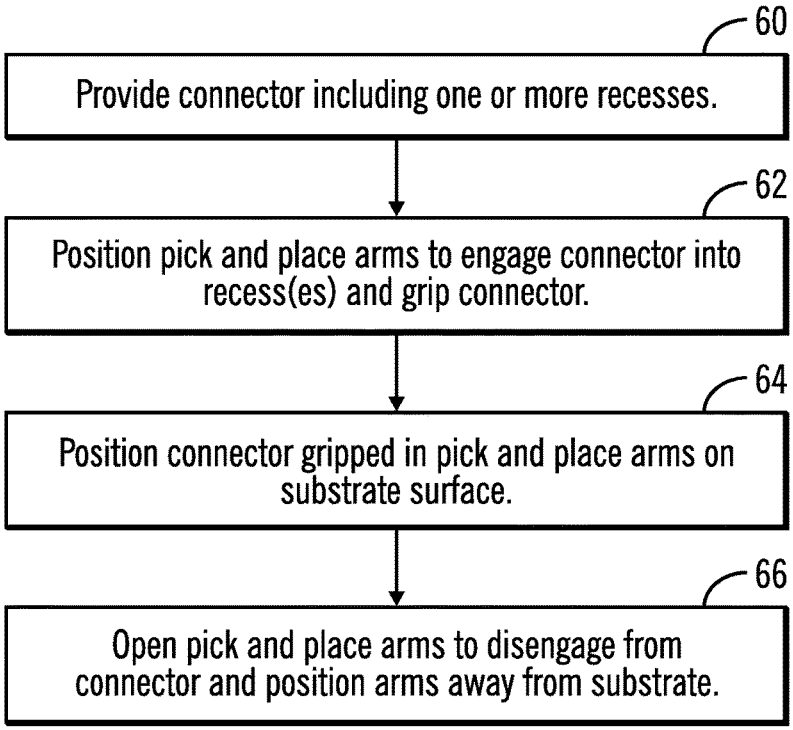
FIG. 6 illustrates a flowchart of operations, in accordance with certain embodiments.

Embodiments also include methods for processing a device including positioning one or more connectors on a substrate. FIG. 6 illustrates a flowchart of operations in accordance with certain embodiments including the formation of a PCB for use in computing systems. Block 60 is providing a connector including at least one recess therein. The recess may be configured to accept an arm of a pick and place machine. While FIG. 1 illustrates an embodiment including two recesses, other embodiments may include one recess or more than two recesses. Block 62 is positioning an arm of the pick and place machine into a recess so that it engages the housing of the connector. If an embodiment such as illustrated in FIG. 1 is used, an arm 34, 36 is positioned in each of the two illustrated recesses 20 to grasp the connector 10.

Block 64 is positioning the connector that is gripped in the arms of the pick and place machine onto the substrate surface. As noted above, the substrate surface may include pads onto which leads extending from the connector may be positioned. A solder connection may be made between the connector and the pads on the substrate. Once the connector is properly positioned on the substrate, Block 66 is opening the pick and place arms to disengage from the connector. The pick and place arms are then moved away from the connector on the substrate. In certain embodiments, soldering of multiple connectors to the substrate may take place after some or all of the multiple connectors are positioned on the substrate surface.

Figure 7:
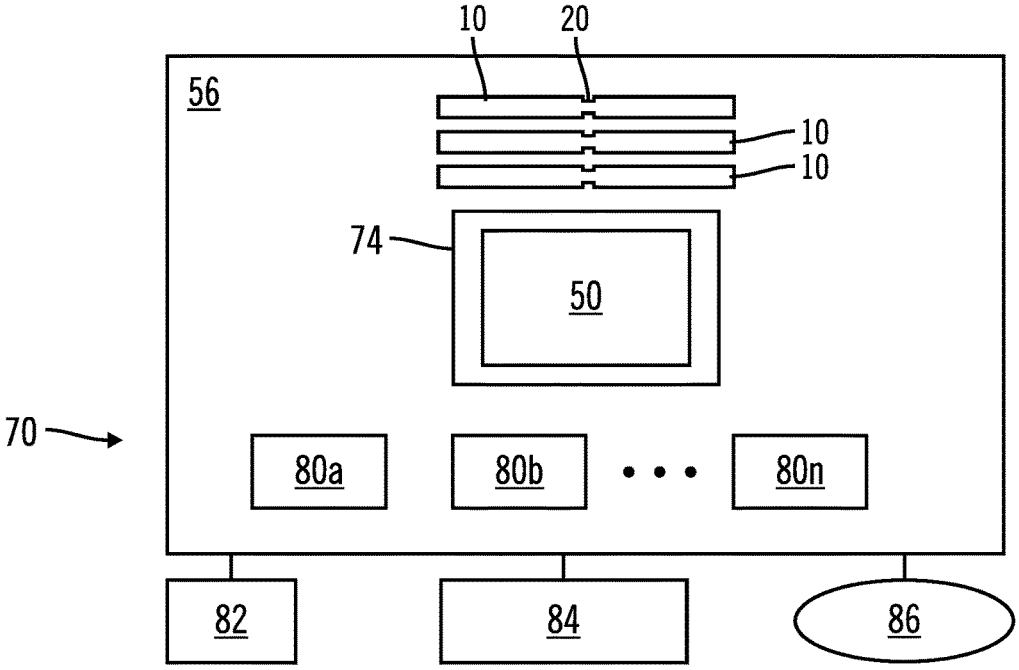
FIG. 7 illustrates an electronic system, in accordance with certain embodiments.

Assemblies including components formed as described in embodiments above may find application in a variety of electronic components. FIG. 7 schematically illustrates one example of an electronic system environment in which aspects of described embodiments may be embodied. Other embodiments need not include all of the features specified in FIG. 7, and may include alternative features not specified in FIG. 7. The system 70 of FIG. 7 may include at least one die such as a CPU 50 positioned in a package substrate 74, which is then coupled to a substrate such as a printed circuit board (PCB) 56.

The system 70 as illustrated in FIG. 7 includes three connectors 10 that include recesses 20 therein. The connectors may be used to couple memory such as DIMMs to the PCB 56. While FIG. 7 illustrates three connectors 10, other numbers of connectors and other components are possible. The connectors 10 may be configured and formed in accordance with embodiments such as described above, including, for example, the presence of the two recesses 20 in each of the connectors 10 illustrated in FIG. 7.

The system 70 may further include one or more controllers 80*a*, 80*b* . . . 80*n*, for a variety of components, which may also be disposed on the PCB 56. The system 70 may be formed with additional components, including, but not limited to, storage 82, display 84, and network connection 86. The system 70 may comprise any suitable computing device, including, but not limited to, a mainframe, server, personal computer, workstation, laptop, tablet, netbook, handheld computer, handheld gaming device, handheld entertainment device (for example, MP3 (moving picture experts group layer-3 audio) player), PDA (personal digital assistant), watch, fitness device, smart phone or other telephony device (wireless or wired), network appliance, virtualization device, storage controller, network controller, router, etc.

Various features of embodiments described above may be implemented with respect to other embodiments, including apparatus and method embodiments. The order of certain operations as set forth in embodiments may also be modified. Specifics in the examples may be used anywhere in one or more embodiments.

In the present description, various features are grouped together for the purpose of streamlining the disclosure. This method of disclosure is not to be interpreted as reflecting an intention that the claimed embodiments of the invention require more features than are expressly recited in each claim. Rather, as the claims reflect, inventive subject matter may lie in less than all features of a single disclosed embodiment. Thus the claims are hereby incorporated into the Detailed Description, with each claim standing on its own as a separate embodiment.

While certain exemplary embodiments are described herein and shown in the accompanying drawings, it is to be understood that such embodiments are merely illustrative and not restrictive, and that embodiments are not restricted to the specific constructions and arrangements shown and described since modifications may occur to those having ordinary skill in the art. For example, in certain embodiments the morphology of the housing 12 and the recesses 20 may differ from those illustrated in the figures and described above.

The terms "a" and "an" mean "one or more", unless expressly specified otherwise. Terms such as "first", "second", and the like may be used herein and do not necessarily denote any particular order, quantity, or importance, but are used to distinguish one element from another. Terms such as "upper", "lower", "top", "bottom", and the like may be used for descriptive purposes only and are not to be construed as limiting.

Devices that are in communication with each other need not be in continuous communication with each other, unless expressly specified otherwise. In addition, devices that are in communication with each other may communicate directly or indirectly through one or more intermediaries. A description of an embodiment with several components in communication with each other does not imply that all such components are required. Embodiments may be manufactured, used, and contained in a variety of positions and orientations.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

EXAMPLES

The following examples pertain to various embodiments. Specifics in the Examples may be used anywhere in one or more embodiments.

Example 1 is a surface mount connector comprising: a housing including inner surfaces surrounding a card edge region and outer surfaces defining an exterior region; and a recess in at least one of the outer surfaces, the recess sized to accept a removably engageable arm therein; wherein the connector defines a cross-sectional width that is smaller in the recess than at a position adjacent to the recess.

In Example 2, the subject matter of Example 1 can optionally include wherein the housing includes a lower surface and an upper surface, wherein the recess extends to the upper surface.

In Example 3, the subject matter of any one of Examples 1-2 can optionally include wherein the housing includes a first recess on a first side and a second recess on a second side opposite the first side.

In Example 4, the subject matter of any one of Examples 1-3 can optionally include wherein the housing includes at least one additional recess sized to engage an arm on the first side, and at least one additional recess sized to engage an arm on the on the second side.

In Example 5, the subject matter of any one of Examples 1-2 can optionally include wherein the housing includes one or more recesses configured to engage an arm on only one side of the connector.

In Example 6, the subject matter of any one of Examples 1-5 can optionally include, further comprising a plurality of contacts in the card edge region.

In Example 7, the subject matter of any one of Examples 1-6 can optionally include wherein the connector is configured to accept a dual in-line memory module (DIMM) therein.

In Example 8, the subject matter of any one of Examples 1-7 can optionally include a system including the surface mount connector of any of Examples 1-7, including a pick and place machine including a plurality of arms to engage and position the connector, wherein an arm of the plurality of arms is configured to engage the connector in the recess.

Example 9 is an electronic device comprising: a substrate comprising a circuit board; a first surface mount connector on the circuit board, the first connector including inner surfaces defining a card edge region and outer surfaces defining an exterior region, the exterior region including a front side first side and a second side opposite the first side, the first side including a recess configured to accept a removably engageable arm therein, wherein the first connector has a cross-sectional width that is smaller in the recess than at a position adjacent to the recess; and a second surface mount connector on the circuit board, the second connector including inner surfaces defining a card edge region and outer surfaces defining an exterior region, the exterior region including a first side and a second side opposite the second side, the first side including a recess configured to accept a removably engageable arm therein, wherein the second connector has a cross-sectional width that is smaller in the recess than at a position adjacent to the recess; wherein the recess in the first surface mount connector faces the recess in the second surface mount connector.

In Example 10, the subject matter of Example 9 can optionally include wherein the second connector second side includes a recess configured to accept a removably engageable arm therein.

In Example 11, the subject matter of any one of Example 9 can optionally include wherein the first connector second side includes a recess configured to accept a removably engageable arm therein, and wherein the second connector second side includes no recess configured to accept a removably engageable arm therein.

In Example 12, the subject matter of any one of Examples 9-11 can optionally include a third surface mount connector on the circuit board, the third connector including inner surfaces defining a card edge region and outer surfaces defining an exterior region, the exterior region including a first side and a second side opposite the first side, the first side including a recess configured to accept a removably engageable arm therein, wherein the third connector has a cross-sectional width that is smaller in the recess than at a position adjacent to the recess; wherein the first connector is positioned between the second connector and the third connector.

In Example 13, the subject matter of any one of Examples 9-10 and 12 may optionally include wherein the second connector second side includes a recess configured to accept a removably engageable arm therein, and wherein the third connector second side includes a recess configured to accept a removably engageable arm therein.

In Example 14, the subject matter of any one of Examples 9 and 12 can optionally include wherein the second connector second side includes no recess configured to accept a removably engageable arm therein.

In Example 15, the subject matter of Example 14 can optionally include wherein the third connector second side includes no recess configured to accept a removably engageable arm therein.

In Example 16, the subject matter of any one of Examples 9-15 can optionally include wherein the first connector is spaced a distance apart from the second connector, and wherein the distance is less than a depth of the recess.

Example 17 is a method for processing a substrate, comprising: providing a connector formed to include recesses on opposite surfaces thereof; positioning arms of a pick and place machine to engage the connector in the recesses; positioning the connector on a substrate while engaged in the arms of the pick and place machine; and disengaging the arms of the pick and place machine from the connector.

In Example 18, the subject matter of Example 17 can optionally include wherein the recesses are each formed to define a depth that is less than that of the arms.

In Example 19, the subject matter of any one of Examples 17-18 can optionally include wherein the recesses are each formed to define a depth that is greater than that of the arms.

In Example 20, the subject matter of any one of Examples 17-19 can optionally include forming a solder connection between the connector and the substrate.

Example 21 is a method for processing a substrate, comprising: positioning a first surface mount connector on a substrate; positioning arms of a pick and place machine to engage a second surface mount connector, the second connector including recesses on opposite surfaces thereof; positioning the second surface mount connector on the substrate adjacent to the first surface mount connector while the second surface mount connector is engaged in the arms of the pick and place machine; and disengaging the arms of the pick and place machine from the second surface mount connector.

In Example 22, the subject matter of Example 21 can optionally include wherein the recesses are each formed to define a depth that is less than that of the arms.

In Example 23, the subject matter of Example 21 can optionally include wherein the recesses are each formed to define a depth that is greater than that of the arms.

In Example 24, the subject matter of any one of Examples 21-23 can optionally include forming a solder connection between the first surface mount connector and the substrate, and forming a solder connection between the second surface mount connector and the substrate.

In Example 25, the subject matter of Example 24 can optionally include forming the solder connection between the first surface mount connector and the substrate after the positioning the second surface mount connector on the substrate.

Example 26 is an apparatus comprising: a substrate; a first surface mount connector on the substrate, the first surface mount connector including inner surfaces defining a card edge region and outer surfaces defining an exterior region, the exterior region including a first side and a second side opposite the first side, the first side and the second side each including a recess configured to accept an arm therein; a second surface mount connector on the substrate, the second surface mount connector including inner surfaces defining a card edge region and outer surfaces defining an exterior region, the exterior region including a first side and a second side opposite the second side, the first side and the second side each including a recess configured to accept an arm therein; and a third surface mount connector on the substrate, the third surface mount connector including inner surfaces defining a card edge region and outer surfaces defining an exterior region, the exterior region including a first side and a second side opposite the second side, the first side and the second side each including a recess configured to accept an arm therein; wherein the first, second, and third surface mount connectors are positioned parallel to each other on the substrate.

In Example 27, the subject matter of Example 26 can optionally include wherein the first, second, and third surface mount connectors are soldered to the substrate.

In Example 28, the subject matter of any one of Examples 26-27 can optionally include wherein the second surface mount connector is positioned between the first surface mount connector and the third surface mount connector, wherein the first surface mount connector and the second surface mount connector are spaced apart a distance, and wherein the distance between the first surface mount connector and the second surface mount connector is less than a depth of the recesses.

Example 29 is a connector comprising a first connector including inner surfaces defining a card edge region and outer surfaces defining an exterior region, the exterior region including a front side first side and a second side opposite the first side, the first side and the second side each including a recess configured to accept a removably engageable arm therein.

Example 30 is a machine readable medium including code, when executed, to cause a machine to perform the method of any one of Examples 17-25.

Example 31 is an apparatus comprising means to perform a method as described in any preceding Example.

What is claimed:

1. A surface mount connector comprising:

a housing including inner surfaces surrounding a card edge region and outer surfaces defining an exterior region; and a recess in at least one of the outer surfaces, the recess sized to extend a distance into the housing without reaching any of the inner surfaces, the recess sized to accept a removably engageable arm therein;

wherein each of the outer surfaces includes no more than one recess sized to accept a removably engageable arm therein; and wherein the surface mount connector defines a cross-sectional width that is smaller in the recess than at a position adjacent to the recess.

2. The surface mount connector of claim 1, the recess extending downward from an upper surface of the surface mount connector a distance that is less than a height of the housing adjacent to the recess.

3. The surface mount connector of claim 1, wherein the housing includes a first recess on a first side and a second recess on a second side opposite the first side.

4. The surface mount connector of claim 3, wherein the housing includes at least one additional recess sized to engage an arm on the first side, and at least one additional recess sized to engage an arm on the second side.

5. A surface mount connector comprising:

a housing including inner surfaces surrounding a card edge region and outer surfaces defining an exterior region; and wherein the housing includes one or more recesses configured to accept a removably engageable arm therein on only a first side of the connector; and wherein the housing includes a second side of the connector opposite the first side of the connector, the second side being configured to engage a removably engageable arm, the second side being free of any recesses configured to accept the removably engageable arm therein.

6. The surface mount connector of claim 5, further comprising a plurality of contacts in the card edge region.

7. The surface mount connector of claim 1, wherein the connector is configured to accept a dual in-line memory module (DIMM) therein.

8. A system including the surface mount connector of claim 1, including a pick and place machine including a plurality of arms to engage and position the surface mount connector, wherein an arm of the plurality of arms is configured to engage the surface mount connector in the recess.

9. An electronic device comprising:

a substrate comprising a circuit board; and a surface mount connector on the circuit board, the surface mount connector including inner surfaces defining a card edge region and outer surfaces defining an exterior region, the exterior region including a first side and a second side opposite the first side, the first side including a recess configured to accept a removably engageable arm therein, the recess extending downward from an upper surface of the surface mount connector a distance that is less than a height of the surface mount connector adjacent to the recess; and wherein each of the outer surfaces includes no more than one recess sized to accept a removably engageable arm therein.

10. The electronic device of claim 9, wherein the surface mount connector is a first surface mount connector, the electronic device further comprising:

a second surface mount connector on the circuit board, the second surface mount connector including inner surfaces defining a card edge region and outer surfaces defining an exterior region, the exterior region including a first side and a second side opposite the first side, the first side including a recess configured to accept a removably engageable arm therein, wherein the first side of the first surface mount connector faces the first side of the second surface mount connector.

11. The electronic device of claim 10, wherein the first surface mount connector second side includes no recess configured to accept a removably engageable arm therein, and wherein the second surface mount connector second side includes no recess configured to accept a removably engageable arm therein.

12. The electronic device of claim 10, comprising:

a third surface mount connector on the circuit board, the third surface mount connector including inner surfaces defining a card edge region and outer surfaces defining an exterior region, the exterior region including a first side and a second side opposite the first side, the first side including a recess configured to accept a removably engageable arm therein;

wherein the first surface mount connector second side includes a recess configured to accept a removably engageable arm therein, and wherein the first surface mount connector is positioned between the second surface mount connector and the third surface mount connector.

13. The electronic device of claim 12, wherein the second surface mount connector second side includes a recess configured to accept a removably engageable arm therein, and wherein the third surface mount connector second side includes a recess configured to accept a removably engageable arm therein.

14. The electronic device of claim 12, wherein the second surface mount connector second side includes no recess configured to accept a removably engageable arm therein, and wherein the third surface mount connector second side includes no recess configured to accept a removably engageable arm therein.

15. The electronic device of claim 10, wherein the first surface mount connector second side includes a recess configured to accept a removably engageable arm therein, and wherein the second surface mount connector second side includes a recess configured to accept a removably engageable arm therein.

16. The electronic device of claim 9, wherein the recess does not extend to any of the inner surfaces, and wherein the recess extending downward from an upper surface of the surface mount connector a distance that is less than a height of the surface mount connector adjacent to the recess.

17. A method for processing a substrate, comprising:

providing a connector formed to include recesses on opposite surfaces thereof;

positioning arms of a pick and place machine in the recesses;

applying a gripping force to the arms in the recesses to grip and fully support the connector;

positioning the connector on the substrate while fully supported by the arms of the pick and place machine; and disengaging the arms of the pick and place machine from the connector.

18. The method of claim 17, wherein the recesses are each formed to define a depth that is less than that of the arms.

19. The method of claim 17, wherein the recesses are each formed to define a depth that is greater than that of the arms.

20. The method of claim 17, further comprising forming a solder connection between the connector and the substrate.

* * * * *